US011244663B1

(12) United States Patent
Perkins et al.

(10) Patent No.: US 11,244,663 B1
(45) Date of Patent: Feb. 8, 2022

(54) FOOT PERCUSSION DEVICE

(71) Applicant: Victoria Rose Advisors LLC, Bronx, NY (US)

(72) Inventors: Victor J. Perkins, Bronx, NY (US); Jaia S. Perkins, Bronx, NY (US)

(73) Assignee: Victoria Rose Advisors LLC, Bronx, NY (US)

( * ) Notice: Subject to any disclaimer, the term of this patent is extended or adjusted under 35 U.S.C. 154(b) by 0 days.

(21) Appl. No.: 17/231,485

(22) Filed: Apr. 15, 2021

(51) Int. Cl.
*G10D 13/10* (2020.01)
*G10H 1/32* (2006.01)

(52) U.S. Cl.
CPC ..... *G10D 13/10* (2020.02); *G10H 1/32* (2013.01); *G10H 2220/525* (2013.01)

(58) Field of Classification Search
CPC ..... G10D 13/10; G10H 1/32; G10H 2220/525
USPC ..... 84/730
See application file for complete search history.

(56) References Cited

U.S. PATENT DOCUMENTS 3,439,568 A * 4/1969 Griffith ..... G10H 1/348 84/600
4,245,539 A * 1/1981 Jones ..... G10H 1/32 84/672
4,660,305 A 4/1987 Medler et al.
5,001,852 A 3/1991 Schwartz
5,063,821 A * 11/1991 Battle ..... G10H 1/32 84/723
5,602,354 A * 2/1997 Martin ..... G10D 13/06 84/410
5,627,336 A * 5/1997 Stevens ..... G10H 1/0555 84/746
5,765,300 A 6/1998 Kianka
7,015,391 B2 3/2006 Tomoda
8,847,057 B2 * 9/2014 Koah ..... G10H 3/146 84/615
10,872,590 B1 * 12/2020 Salisbury ..... G10H 3/143
2004/0184634 A1 * 9/2004 Nastasic ..... A63J 5/04 381/361
2012/0297960 A1 11/2012 Bader
2013/0305910 A1 * 11/2013 Koah ..... G10H 3/146 84/730
2018/0007996 A1 1/2018 Sedwick et al.
2019/0139520 A1 * 5/2019 Floyd ..... G10H 3/146

OTHER PUBLICATIONS

WIKIPEDIA; Article entitled: "Stomp Box", located at <https://en.wikipedia.org/wiki/Stomp_box>, published on Mar. 27, 2021, 3 pgs.

(Continued)

*Primary Examiner* — Jeffrey Donels
(74) *Attorney, Agent, or Firm* — Taylor English Duma LLP

(57) ABSTRACT

A foot percussion device can include a rigid board defining an upper surface and a lower surface distal from the upper surface; a spacer secured to and extending from the lower surface of the board, the spacer being compressible and defining a height before compression, the spacer configured to isolate the board from contact with a floor surface on which the device is placed; an audio jack; and a sensor in contact with and secured to one of the upper surface and the lower surface of the board, the sensor configured to convert mechanical vibrations in the board to electrical signals transmittable through the audio jack.

20 Claims, 11 Drawing Sheets

(56) References Cited

OTHER PUBLICATIONS

The ESP Guitar Company; Article entitled: "What is a Piezo Pickup?", located at <http://www/espguitars.com/articles/2007152-what-is-a-piezo-pickup>, accessed on Nov. 18, 2020, 4 pgs.
amazon.com; Article entitled: "Self-Adhesive Pickups Piezo Transducer, 3 in 1 Microphone Contact & Endpin Jack 1.4" for Electronic Acoustic Guitar Violin", located at <https://www.amazon.com/Self-adhesive-Transducer-Celluloid-Microphone-Electronic/dp/BP073ZH1FNX>, accessed on Mar. 5, 2021, 10 pgs.
O'mara Sprung Floors; "Article entitled: ProLine Portable Tap Dance Floor & Travel Board", located at <https://sprungfloors.com/shop/wooden-dance-floors/tap-dance-floors/travel-board/>, accessed on Nov. 18, 2020, 4 pgs.

* cited by examiner

FOOT PERCUSSION DEVICE

TECHNICAL FIELD

Field of Use

This disclosure relates to foot percussion devices. More specifically, this disclosure relates to portable foot percussion devices comprising a sensor configured to transmit electrical signals to sound equipment for amplification.

Related Art

Musicians and singers can literally have their hands full with an instrument and other sound equipment or can otherwise find it helpful to operate an instrument or equipment controller with their feet. Similar in concept to video arcade games that involve users dancing on a surface of the game, however, the controller neither creates nor amplifies a sound. Rather, pressing an interface of the controller—or the surface of the game or, similarly, the keys on a simple electronic keyboard—simply sends a signal to a console to perform an action, which can include emitting a pre-recorded sound.

A typical dancing board, even if intended for use by a dancer, does not facilitate long-term use. Furthermore, the boards are usually small and merely acoustic in operation. As such, a percussive dancer who uses their feet to make music in a performance—through, e.g., tap dancing, step dancing, flamenco dancing, or kathak—cannot typically be heard over amplified instruments. The performer must generally rely on the band to lower the music or "play the pause" and hope that she do not move beyond a limited range of any microphone proximate to the ground or the dancing board.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is a foot percussion device comprising: a rigid board defining an upper surface and a lower surface distal from the upper surface; a spacer secured to and extending from the lower surface of the board, the spacer being compressible and defining a height before compression, the spacer configured to isolate the board from contact with a floor surface on which the assembly is placed; an audio jack; and a sensor in contact with and secured to one of the upper surface and the lower surface of the board, the sensor configured to convert mechanical vibrations in the board to electrical signals transmittable through the audio jack.

In a further aspect, disclosed is a method of using a foot percussion device, the method comprising: positioning a board of the device on a floor surface, the device comprising a sensor in contact with and secured to the lower surface of the board, the sensor being a piezo transducer; sensing with the sensor mechanical vibrations resulting from impacts against an upper surface of the board by a foot of a user of the system, the assembly comprising a spacer secured to and extending from the lower surface of the board, the spacer being compressible, the spacer configured to isolate the board from contact with the floor surface; converting the mechanical vibrations to electrical signals with the sensor; transmitting the electrical signals from the sensor to sound equipment of the system via a cable; and amplifying the electrical signals with the sound equipment to produce a sound audible through speakers of the system.

In yet another aspect, disclosed is a method comprising: positioning a sensor in a sensor location on an upper surface of a floor surface of the system, the sensor being a piezo transducer; sensing with the sensor mechanical vibrations resulting from impacts against the floor surface by a foot of a user of the system; converting the mechanical vibrations to electrical signals with the sensor; transmitting the electrical signals from the sensor to sound equipment of the system via a cable; and amplifying the electrical signals with the sound equipment to produce a sound audible through speakers of the system.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and together with the description, serve to explain various principles of the disclosure. The drawings are not necessarily drawn to scale. Corresponding features and components throughout the figures may be designated by matching reference characters for the sake of consistency and clarity.

DETAILED DESCRIPTION

Figure 1:
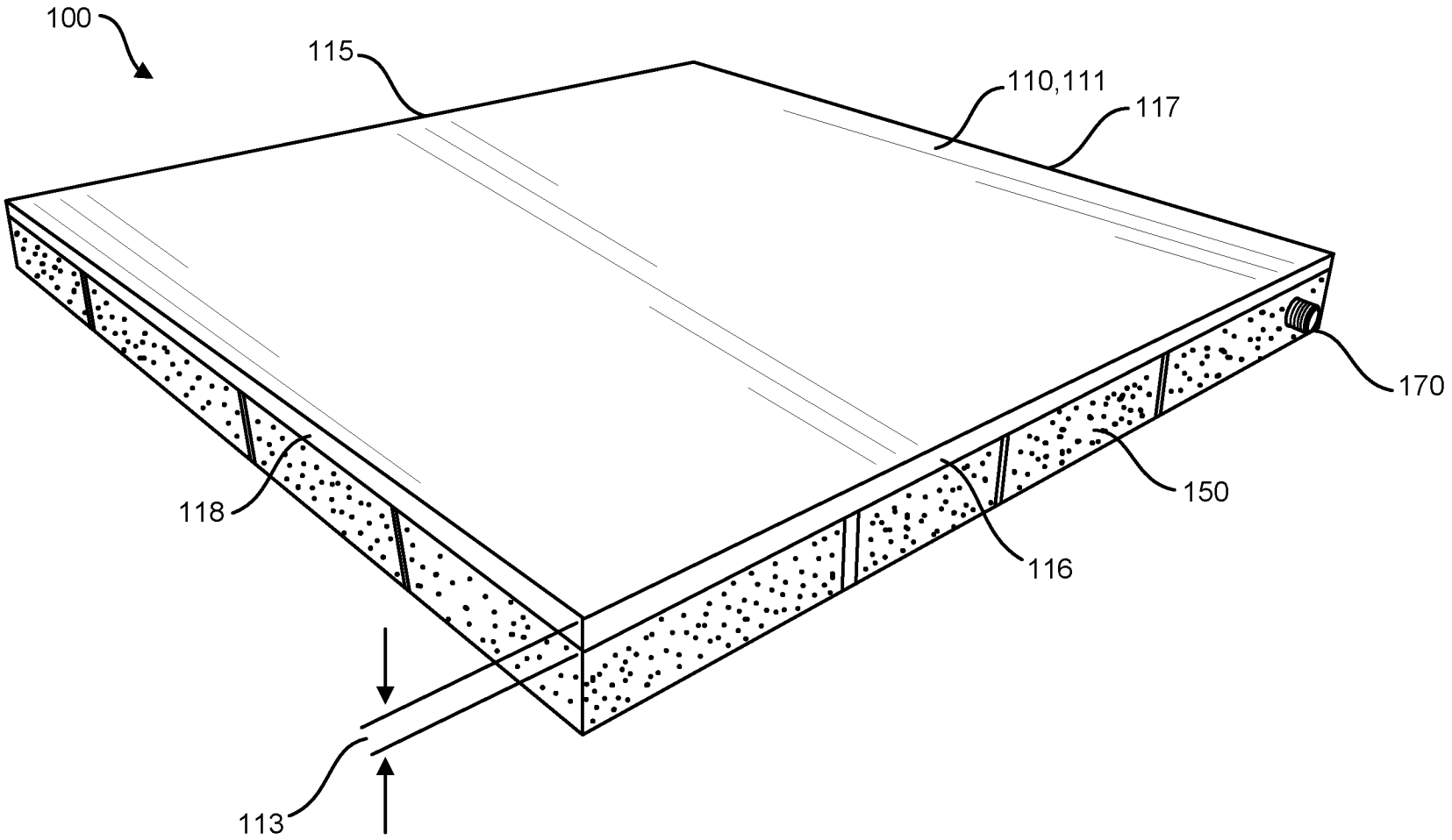
FIG. 1 is a perspective top view of an assembly and, more specifically, a foot percussion device in accordance with one aspect of the current disclosure.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise. In addition, any of the elements described herein can be a first such element, a second such element, and so forth (e.g., a first widget and a second widget, even if only a "widget" is referenced).

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list. The phrase "at least one of A and B" as used herein means "only A, only B, or both A and B"; while the phrase "one of A and B" means "A or B."

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "rear" describes that end of the foot percussion device defining an audio jack thereof; "front" is that end of the seat that is opposite or distal the rear; "left" is that which is to the left of or facing left from a person standing on the foot percussion device and facing towards the front; and "right" is that which is to the right of or facing right from that same person while standing on the foot percussion device and facing towards the front. "Horizontal" or "horizontal orientation" describes that which is in a plane extending from left to right and aligned with the horizon. "Vertical" or "vertical orientation" describes that which is in a plane that is angled at 90 degrees to the horizontal.

In one aspect, a foot percussion device and associated methods, systems, devices, and various apparatuses are disclosed herein. In one aspect, the foot percussion device can comprise a piezo sensor and at least one spacer.

Musicians and singers can literally have their hands full with an instrument and other sound equipment or can otherwise find it helpful to operate an instrument or equipment controller with their feet. Similar in concept to video arcade games that involve users dancing on a surface of the game, however, the controller neither creates nor amplifies the sound. Rather, pressing an interface of the controller—or the surface of the game or, similarly, the keys on a simple electronic keyboard—simply sends a signal to a console to perform an action, which can include emitting a pre-recorded sound.

A typical dancing board, even if intended for use by a dancer, does not facilitate long-term use. Furthermore, the boards are usually small, are usually acoustic or usually will not effectively pick up sounds produced by impacts of the feet against a surface of the board.

A percussive dancer who uses their feet to make music in a performance—through, e.g., tap dancing, step dancing, flamenco dancing, or kathak—cannot typically be heard over amplified instruments. Previous attempts to make a dancer's performance heard have been focused on enhancing the dancer's shoes to obtain a better sound by incorporating sound-producing structures or sensors in the shoes. Acoustic dancing boards and floor surfaces cannot electronically amplify a dancer's steps and cannot be heard in large arenas. Such systems rely on microphones to pull sound from the air and, as a result, background noise including sounds produced by other members of a band can also be picked up.

Without special shoes or when using dance forms such as kathak, in which the dancer uses her bare fee to make percussive sounds, the performer must generally rely on the band to lower the music or "play the pause" and hope that she do not move beyond a limited range of any microphone proximate to the ground near her performance. At times in a performance such as when, for example and without limitation, a perform slides across the stage the sound can become entirely inaudible. Sometimes, a tap dancer must "tap" much harder to increase the volume, increasing fatigue and reducing the range of available amplitudes of sound, and even then she still may be able to perform in only smaller arenas as a result. In contrast, the foot percussion device disclosed herein can connect to standard sound equipment for amplification and/or alteration and thereby fairly compete with other amplified instruments.

FIG. 1 is a perspective top view of an assembly, which can be a foot percussion device 100, in accordance with one aspect of the current disclosure. The device 100 can comprise a board 110, a spacer 150, and a transducer or sensor 450 (shown in FIG. 4A), which can be a piezoelectric transducer or piezo sensor. The device 100 can further comprise an audio jack 170, which can be assembled to and can extend from the spacer 150 or one of the other components of the device 100.

The board 110 can define an upper surface 111 and a lower surface 112 (shown in FIG. 2) distal from the upper surface 111. The device 100 and, more specifically, the board 110 can further define a first or front end 115, a second or rear end 116, a third or right end 117, and a fourth or left end 118. Adjacent ends of the device 100 and, more specifically, the board 110 can intersect at corners, which can be sharp or can define an edge treatment such as a radius or chamfer. The board 110 can define, as desired, any one of a variety of shapes. In some aspects, as shown, the board 110 can define a rectangular shape or, more specifically, a square shape. In some aspects, the board 110 can define any polygonal shape. In some aspects, the board 110 can define a circular shape. In some aspects, the board 110 can define an irregular shape.

The board 110 can be rigid, i.e., the board 110 can be formed from a rigid material that is configured to resist bending or compressing under load. The board 110, even when rigid, can be configured by its properties and dimensions to flex and be resonant, i.e., to resonate or vibrate at a frequency, and through resonation or vibration of the board 110 a sound can be produced. As shown, the board 110 can be solid and can extend uninterrupted from the upper surface 111 to the lower surface 112. More specifically, in some aspects, the board 110 can comprise or be formed from wood. Even more specifically, the board 110 can be formed from or can comprise a plywood material. For example and without limitation, a plywood forming the board 110 can comprise birch, oak, or pine varieties of wood and can be sanded smooth to facilitate a smooth and consistent surface for dancing on the upper surface 111 and a good connection for the sensor 450 on the lower surface 112. For example and without limitation, the plywood can define a grade BB surface on at least one of the surfaces 111,112. In some aspects, the board 110 can be formed from or can comprise a non-wood material.

In some aspects, to facilitate strength and also resonance, a nominal thickness 113 (or rated thickness) of the board 110 can be at least 0.5 inches. In some aspects, the nominal thickness 113 can be at least 0.75 inches. In some aspects, the nominal thickness 113 can be between 0.5 inches and 0.75 inches, inclusive of the endpoints of the range. For example and without limitation, an actual thickness of the board 110 when defining the nominal thickness 113 of 0.5 inches can be 15⁄32 inch, and the actual thickness of the board 110 when defining the nominal thickness 113 of 0.75 inches can be 23⁄32 inch. In some aspects, the nominal thickness 113 can be below 0.5 inches or above 0.75 inches as desired.

The board 110 can define a logo or artwork, which can be applied to a surface of the board 110 such as the upper surface 111 or the lower surface 112. The logo or artwork can be affixed to the board using an ink transfer method or other printing or application process. A finish, which can be clear and can comprise a resin material, can be applied onto the board 110 and can increase a resistance of the board 110 to damage by abrasion or fluids.

Figure 2:
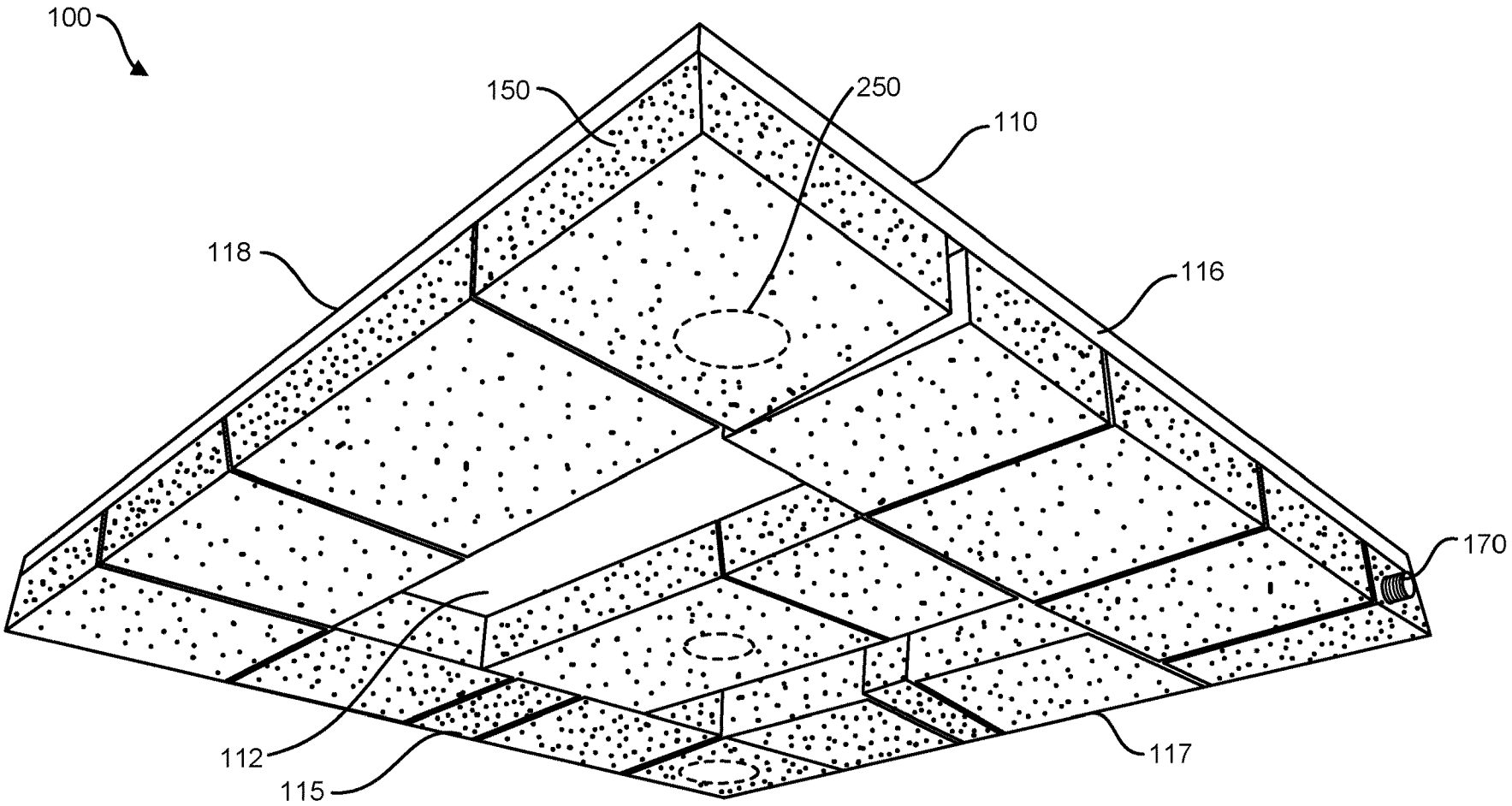
FIG. 2 is a perspective bottom view of the device of FIG. 1.

FIG. 2 is a perspective bottom view of the device 100 of FIG. 1. The spacer 150 can be secured to and can extend from the lower surface 112 of the board 110. In some aspects, as shown, the device 100 can comprise a plurality of spacers 150. In some aspects, the device 100 can comprise a single instance of the spacer 150, which can be cut (e.g., through a die-cut process) to cover at least a portion of the bottom surface 112 or an entirety of the bottom surface 112. Each of the spacers 150 can isolate—and be configured to isolate—the board 110 from direct contact with a floor surface 1001 (shown in FIGS. 10 and 11) on which the device 100 can be placed. The spacer 150 can comprise a compressible material to facilitate, for example, absorption of impact forces created by the feet of a user of the device 100 and thereby also reduce the stress on the joints of the user. In some aspects, a density of the spacer 150 can be less than or equal to 4.0 pounds per cubic foot. In some aspects, a density of the spacer 150 can be less than or equal to 3.0 pounds per cubic foot. In some aspects, a density of the spacer 150 can be less than or equal to 2.5 pounds per cubic foot. In some aspects, a density of the spacer 150 can be less than or equal to 2.0 pounds per cubic foot. In some aspects, a density of the spacer 150 can be between 2.0 and 3.0 pounds per cubic foot, inclusive of the endpoints of the range. An edge or edges of the spacer 150 can be aligned with one or more edges of the board 110 such as, for example and without limitation, the ends 115,116,117,118.

Figure 12:
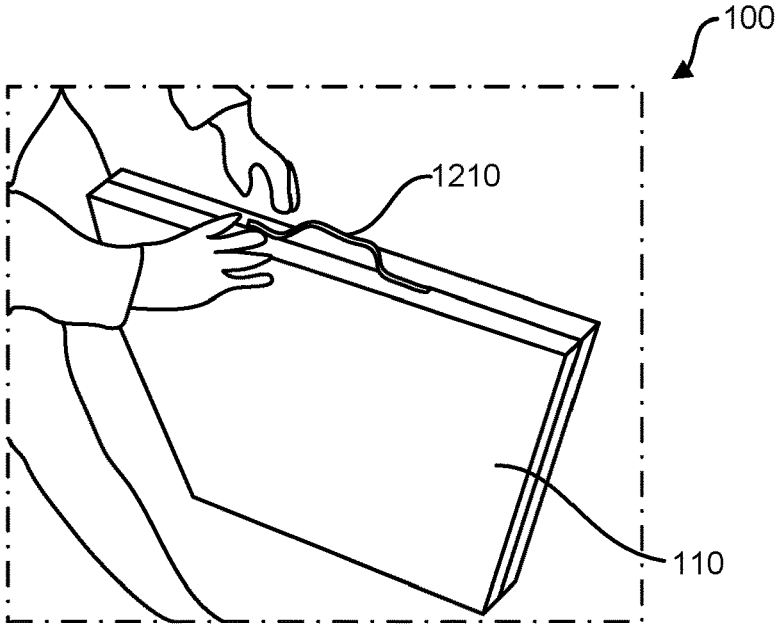
FIG. 12 is a side perspective view of the device of FIG. 1 in accordance with another aspect of the current disclosure in which the device can be folded for storage and/or transport.

In some aspects, the one or more spacers 150 (and, more specifically, a bottom surface 502 thereof; see FIG. 5) can together be affixed or secured to a second board (not shown), which can directly contact the floor surface 1001. In such aspects, the one or more spacers 150 can be sandwiched between the board 110 and the second board. In some aspects, the second board can have or define any one or more specifications of the board 110. In some aspects, the second board can be identical to the board 110. In some aspects, the second board can differ from the board 110 in one or more characteristics such that, for example and without limitation, the second board is thinner, made from a different material, and/or defines different overall dimensions or a different shape than the board 110. Where present, the second board can be sized or configured in one or more portions or sections to facilitate, as shown in FIG. 12, folding of the device 100.

Figure 3:
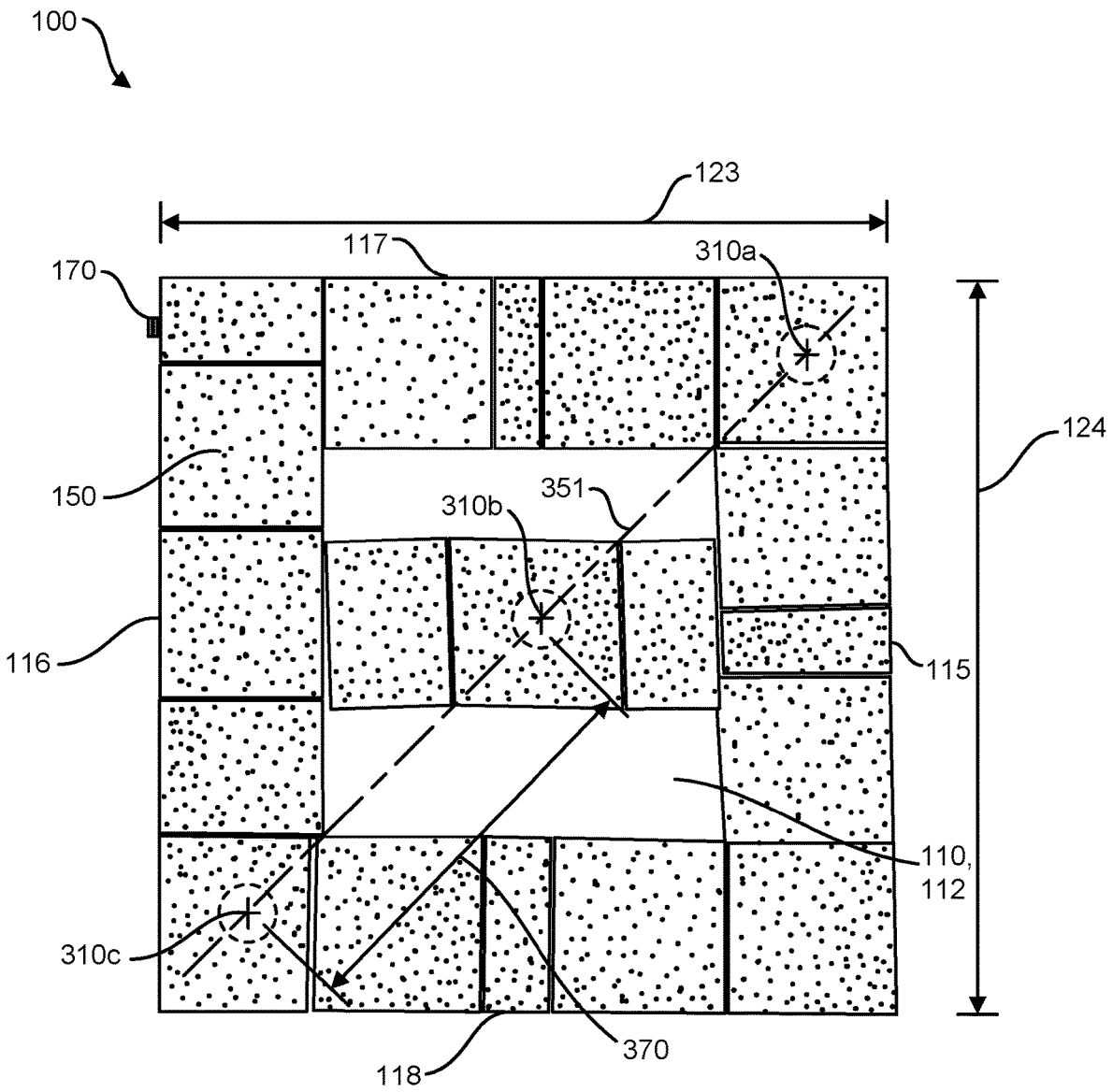
FIG. 3 is a bottom plan view of the device of FIG. 1.

FIG. 3 is a bottom plan view of the device 100 of FIG. 1. The board 110 can define a front-to-back length 123, which can a maximum dimension in a front-to-back orientation or direction, and a left-to-right or side-to-side width 124, which can a maximum dimension in a side-to-side orientation or direction. In some aspects, each of the length 123 and the width 124 can be at least two feet. In some aspects, each of the length 123 and the width 124 can be at least three feet. In some aspects, each of the length 123 and the width 124 can be at least four feet. In some aspects, each of the length 123 and the width 124 can be between two feet and four feet.

Figure 4A:
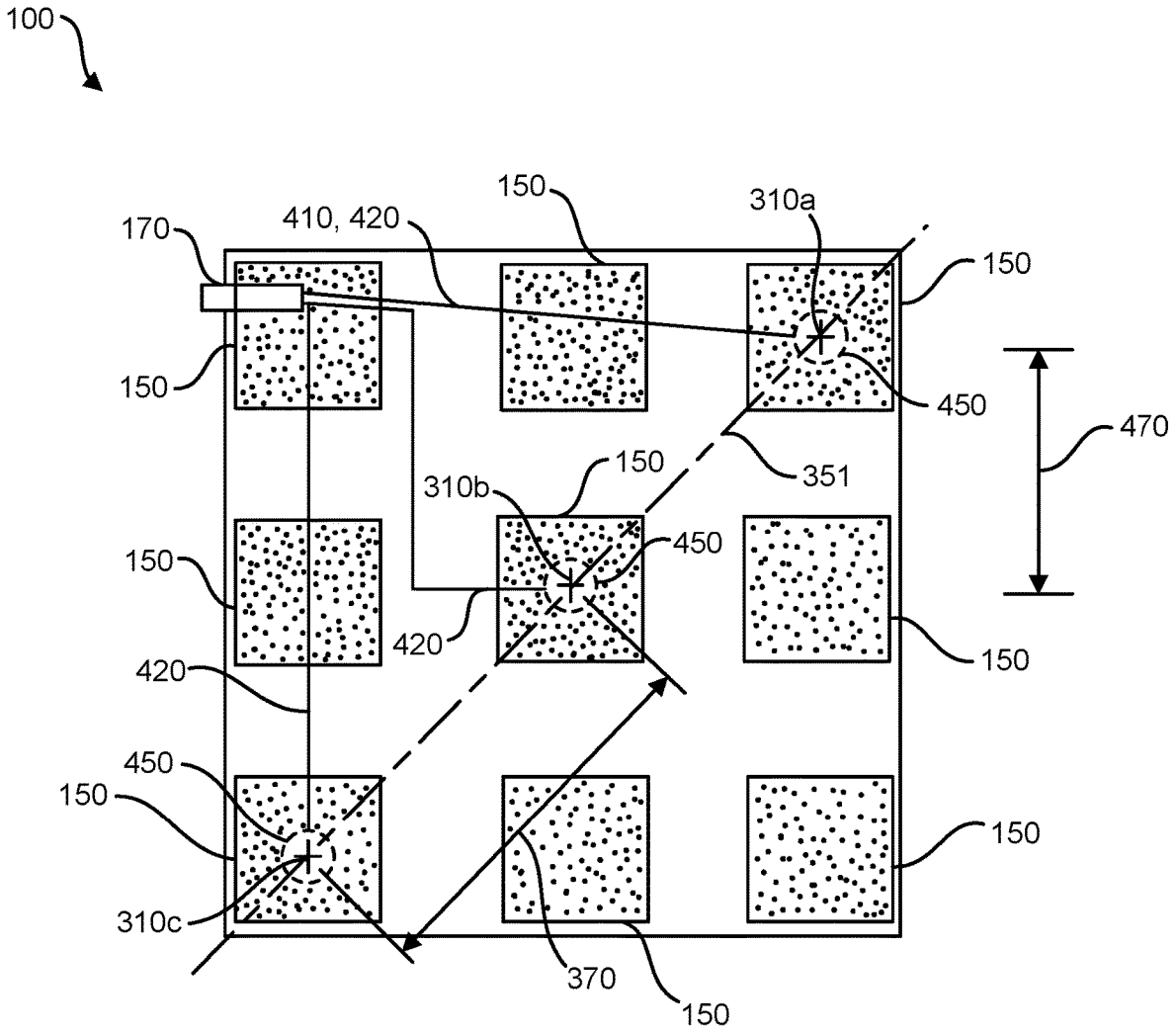
FIG. 4A is a bottom plan view of the device of FIG. 1 in accordance with another aspect of the current disclosure.

The spacers 150 can be arranged in any one of a variety of patterns on the board 110, or they can be arranged without a discernible pattern but still able to support the board 110. In some aspects, as shown, the spacers 150 can extend around a perimeter of the board 110. The arrangement of the spacers 150 can be continuous, i.e., touching each other around, or adjacent spacers 150 can define a gap therebetween. As shown in FIG. 4A, respective centers of any one or more pairs of the adjacent spacers 150 can be spaced apart from each other on the board 110 by a spacer separation distance 470, which can be measured between respective centers of one or more pairs of the adjacent spacers 150. Back to FIG. 3, one or more spacers 150 can extend across a middle of the board 110 from the first end 115 to the second end 116, as shown, or from the third end 117 to the fourth end 118.

The sensors 450 (shown in FIG. 4A) can be positioned at one or more sensor locations such as sensor locations 310*a,b,c*. As shown, the sensor locations 310*a,b,c* can coincide with positions of one or more of the spacers 150, which can be identified by reference to a center or an edge of each. Furthermore, the spacer 150 can cover any one of the sensor locations 310*a,b,c* and can cover the corresponding sensor 450 itself. In some aspects, as shown in FIG. 2, one or more of the sensor locations 310*a,b,c* can be identified with a mark 250 defined on a visible surface of the spacer 150. Back to FIG. 3, adjacent sensor locations 310*a,b,c* of the sensor locations 310*a,b,c* can be spaced apart from each other by a sensor separation distance 370, which can be measured between respective centers of one or more pairs of the adjacent sensors 450. The sensor locations 310*a,b,c* and the sensors 450 themselves can be aligned along an axis or line 351, which can be oriented in any one of a number of orientations as desirable. Aligning the sensors 450 along the line 351, which itself can be aligned with geometry of the board 110 such that the line 351 extends between opposing corners or along a central axis of the board 110, or otherwise distributing the sensors 450 in a pattern on the board 110 can aid a user or dancer in creating a consistent and predictable sound using the device 100. As shown, the line 351 can extend diagonally across the board 110 between a pair of opposing corners.

FIG. 4A is a bottom plan view of the device 100 of FIG. 1 in accordance with another aspect of the current disclosure. A sensor harness 410 can comprise one or more sensors 450 and a lead wire 420 extending from each sensor 450. The sensor harness can further comprise the audio jack 170. As shown, the device 100 can comprise a plurality of sensors 450. Adjacent sensors 450 of the plurality of sensors 450 can be spaced apart from each other by the sensor separation distance 370. In some aspects, the sensor separation distance 370 can measure between three and twelve inches, inclusive of the endpoints of the range. In some aspects, the sensor separation distance 370 can measure between six and twelve inches, inclusive of the endpoints of the range. In some aspects, the sensor separation distance 370 can measure between six and ten inches, inclusive of the endpoints of the range. In some aspects, the sensor separation distance 370 can measure eight inches. In some aspects, the sensor separation distance 370 can measure outside of the above ranges or dimensions. In some aspects, as shown, one of more of the spacers 150 can be placed at or proximate to each corner of the board 110. In some aspects, one or more of the spacer 150 can be placed in a center of each of the ends 115,116,117,118 of the board 110 or halfway between the aforementioned corners. In some aspects, one or more of the spacers 150 can be placed in a center of the board 110. In some aspects, a position of one or more of the spacers 150 can be adjusted based on placement of any artwork or graphics on the back of the board 110 in order to avoid blocking such artwork.

Figure 4B:
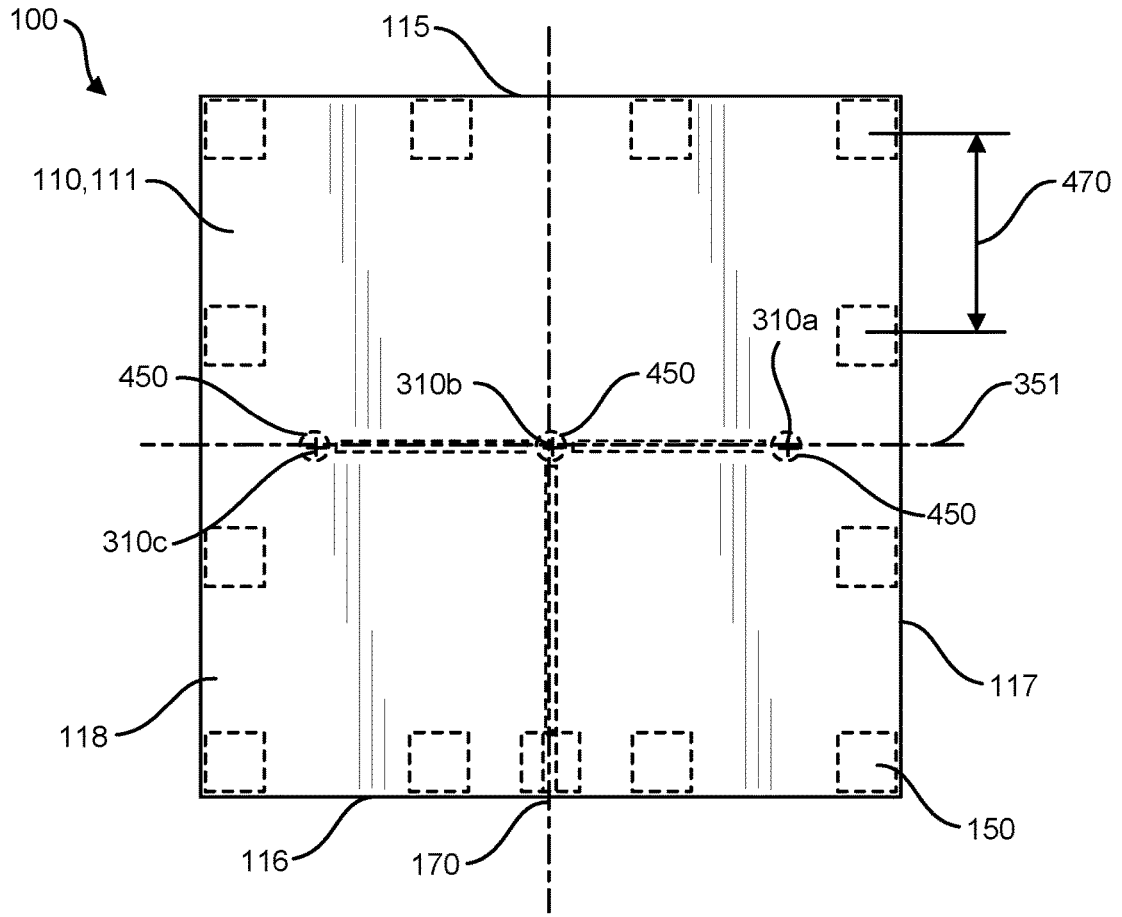
FIG. 4B is a top plan view of the device of FIG. 1 in accordance with yet another aspect of the current disclosure.

FIG. 4B is a top plan view of the device 100 of FIG. 1 in accordance with yet another aspect of the current disclosure. In some aspects, the spacer separation distance 470 can be within a range of six to nine inches, inclusive of the end points of the range. As shown, the line 351, along which the sensors 450 can be aligned, can extend along a left-to-right centerline of the board 110 between the third or right end 117 and the fourth or left end 118. In some aspects, one of the sensors 450 can be positioned in a geometric center of the board in a plan view as shown. As shown, the spacers 150 need not cover the sensors 450, or a separate cover (not shown) can cover the sensors 450. In some aspects, the sensors 450 can be exposed, i.e., without any cover.

Figure 4C:
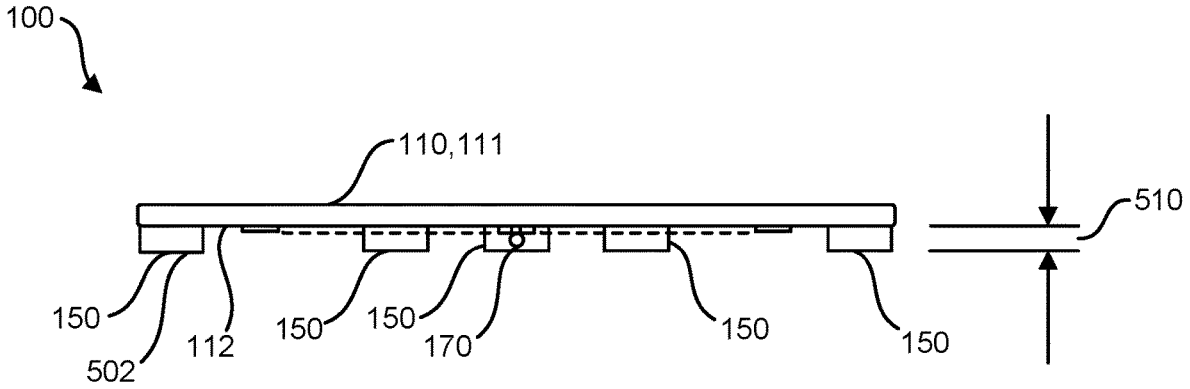
FIG. 4C is a rear elevation view of the device of FIG. 4B.

FIG. 4C is a rear elevation view of the device 100 of FIG. 4B. Each of the spacers 150 can define a height 510. In some aspects, the height 510 can measure at least one inch. In some aspects, the height 510 can measure greater than one inch or less than one inch. In some aspects, the height 510 can measure 0.75 inches. Each of the plurality of spacers 150 can be thereby configured to isolate the board 110 from direct contact with a floor surface such as the floor surface 1001 (shown in FIG. 10) on which the device 100 can be configured to be placed. The spacer 150 through or to which the audio jack 170 can be assembled can be formed from a different material—for example and without limitation, a more rigid material such as wood—or can be formed from the same compressible material forming the other spacers 150.

Figure 5:
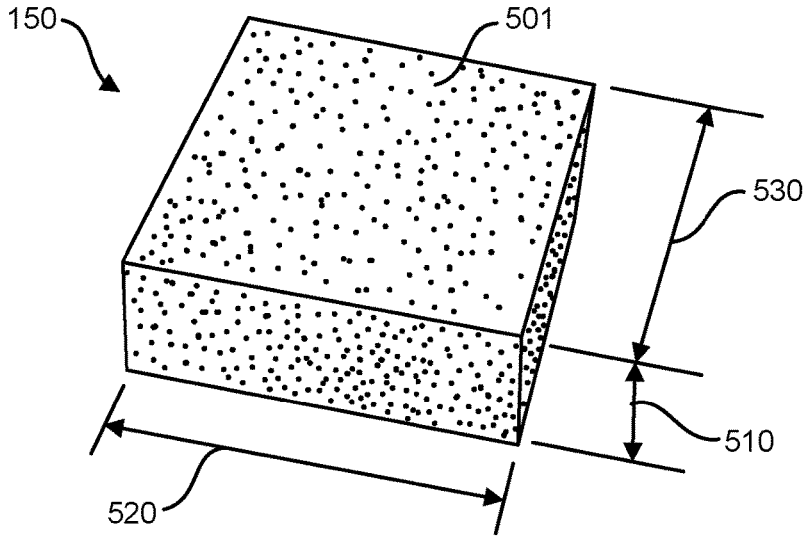
FIG. 5 is a top perspective view of a spacer of the device of FIG. 1.

FIG. 5 is a top perspective view of a spacer 150 of the device 100 of FIG. 1. The spacer 150 can define a top surface 501 and a bottom surface 502 (shown in FIG. 4C) and can define the aforementioned height 510, a length 520, and a width 530. In some aspects, the spacer 150 can define a rectangular or even square shape as shown. In some aspects, the spacer 150 can define another shape such as, for example and without limitation, a circular shape, a non-rectangular polygonal shape, or some irregular shape. Again, as described above, a single spacer 150 can define a more complex shape extending across the bottom surface 112 (shown in FIG. 2) of the board. The top surface 501 of the spacer 150 or the board 110 can comprise a fastener for affixing the spacer 150 to the board 110. In some aspects, the top surface 501—or the lower surface 112 of the board 110—can comprise an adhesive material—for example and without limitation, a pressure-sensitive adhesive with a releasable liner—for affixing the spacer 150 to the board 110. The bottom surface 502 can similarly comprise an adhesive material, such as when the board 110 need not be re-positioned, or can be free of adhesive to facilitate re-positioning as desired. In aspects, the material forming the spacer 150 or any portion thereof—or a lower surface of the aforementioned second board, where present—can resist sliding or can comprise an anti-skid material at the bottom surface 502.

In some aspects, the fastener at or, at least in part, defining the top surface 501 of the spacer 150 can be a removable and reusable fastener such as, for example and without limitation, a screw or a magnet, which can be affixed to or extend through the spacer 150 and a portion of the board 110 configured to receive and/or attract same. By "removable and reusable," it is meant that at least a portion of the fastener is configured to be removed from a mating structure such as the board 110 and/or the spacer 150 and, as desired, reassembled to the mating structure with similar properties including an adhesion or connecting force as when originally assembled (i.e., not configured for one-time use). In some aspects, the removable and reusable fastener can be configured for repeated removal and reuse. More specifically, either or both of the spacer 150 and the board 110 can define a hole or recess to receive the fastener securing the spacer 150 to the board or comprise a material to attract and remain securely attached to each other during use. In some aspects, a plate or bracket can extend between the board 110 and the spacer 150 to facilitate secure attachment of the spacer 150 to the board 110. In some aspects, whether or not the fastener securing the spacer 150 to the board 110 is removable, the spacer 150 can itself be removable and replaceable. More specifically, in some aspects, the spacer 150 can itself be removable and replaceable without damaging the board 110 or the spacer 110 or leaving residue on the board 110. In some aspects, the spacer 150 can comprise, at the top surface 501 or the bottom surface 502 or somewhere in between, a rigid material to, for example and without limitation, facilitate secure attachment of every portion of a surface of the spacer 150 to the board 110, to maintain a shape of the spacer 150, and/or to protect an exposed surface of the spacer 150 during use of the device 100.

In some aspects, the aforementioned removable and reusable fastener can comprise a hook-and-loop fastener comprising a hook portion and a loop portion. More specifically, for example and without limitation, the hook portion can be secured to the board 110 with an adhesive material and the loop portion can be secured to the spacer 150. In some aspects, one or more spacers 150 can be removed during transport and/or storage of the device 100. In some aspects, any individual spacer 150 can be repositioned from a first position to a second position on the board 110 as desired by a user, and extra instances of the aforementioned fastener or a large sheet of fastener material—such as in the case of the hook-and-loop fastener—can be secured to the board 110 to facilitate such repositioning by a user without additional preparation of the board.

In some aspects, the height 510, the length 520, and the width 530 of each of the spacers 150 can be the same and, more specifically, can be two inches. In some aspects, the height 510, the length 520, and the width 530 of each of the spacers 150 can differ from each other and can be more or less than two inches. As shown, the length 520 and the width 530 of each of the spacers 150 can measure the same and can both be much greater. In some aspects, for example and without limitation, a ratio of each of the length 520 and the width 530 to the height 510 can be at least 3. In some aspects, a ratio of each of the length 520 and the width 530 to the height 510 can be at least 4. For example and without limitation, a ratio of each of the length 520 and the width 530 to the height 510 can be at least 5.

In some aspects, the each of the spacers 150 can be compressible to at least 35% of the height 510 before compression of the spacer 150 at a pressure of 27 pounds per square inch (PSI). More specifically, in some aspects, a compressive strength of a material forming the spacer 150 can be less than or equal to 27 PSI at 35% of the original height 510. In some aspects, at least as measured by ASTM D3575 (titled Standard Test Methods for Flexible Cellular Materials Made from Olefin Polymers and available from ASTM International), a compressive strength of a material forming the spacer 150 can be less than or equal to 46 PSI at 25% of the original height 510 and/or less than or equal to 66 PSI at 50% of the original height 510. In some aspects, a compressive strength of a material forming the spacer 150 can be less than or equal to 28 PSI at 25% of the original height 510 and/or less than or equal to 39.5 PSI at 50% of the original height 510. In some aspects, a compressive strength of a material forming the spacer 150 can be less than or equal to 16.5 PSI at 25% of the original height 510 and/or less than or equal to 20 PSI at 50% of the original height 510. In some aspects, a compressive strength of a material forming the spacer 150 can be less than or equal to 8 PSI at 25% of the original height 510 and/or less than or equal to 14.5 PSI at 50% of the original height 510. In some aspects, a compressive strength of a material forming the spacer 150 can be less than or equal to 7 PSI at 25% of the original height 510 and/or less than or equal to 14 PSI at 50% of the original height 510. In some aspects, a compressive strength of a material forming the spacer 150 can be less than or equal to 12 PSI at 50% of the original height 510.

Each of the spacers 150 can be formed from closed-cell foam material. More specifically, each of the spacers 150 can be formed from a cross-linked foam material. In some aspects, each of the spacers 150 can be formed from polyethylene. In some aspects, when the spacer 150 is formed from a material such as, for example and without limitation, a cross-linked polyethylene foam material, audible noises resulting from compression of the material can be reduced or eliminated. In some aspects, each of the spacers 150 can be formed from polypropylene. In some aspects, each of the spacers 150 can be formed from polyurethane. In some aspects, each of the spacers 150 can be formed from another compressible material such as, for example and without limitation, natural or synthetic rubber. In some aspects, each of the spacers 150 can be formed from a cloth or fabric material. In some aspects, one or more of the spacers 150 can comprise any compressible or deformable structure defining the height 510. In some aspects, for example and without limitation, one or more of the spacers 150 can comprise a spring such as, for example and without limitation, a coil spring, a wave spring, or a leaf spring, which can be secured to the board 110 with one or more fasteners and can, as desired, further comprise a plate or disc or other portion defining either or both of the top surface 501 and the bottom surface 502 of the spacer 150. In some aspects, each of the spacers 150 can be formed from or comprise a non-compressible material (at least non-compressible under loads experienced during use of the device 100) such as, for example and without limitation, wood, metal, or plastic.

Figure 6A:
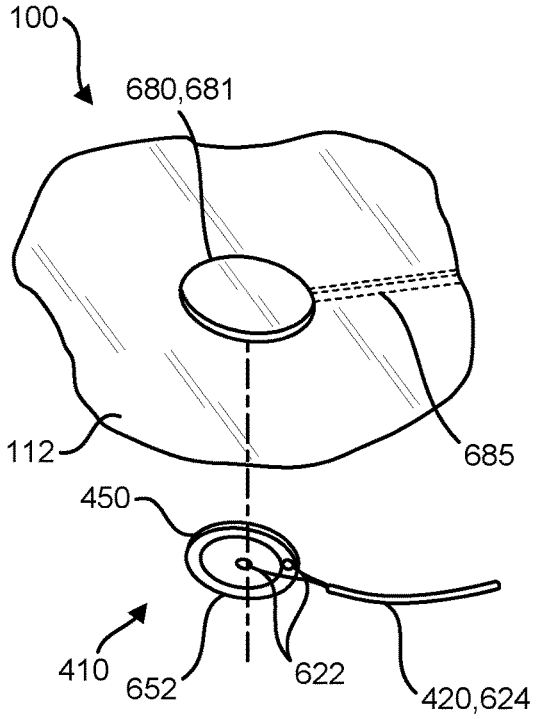
FIG. 6A is a detail bottom perspective view of the device of FIG. 1 showing an assembly of a sensor of the device of FIG. 1 and a board of the device of FIG. 1.
Figure 6B:
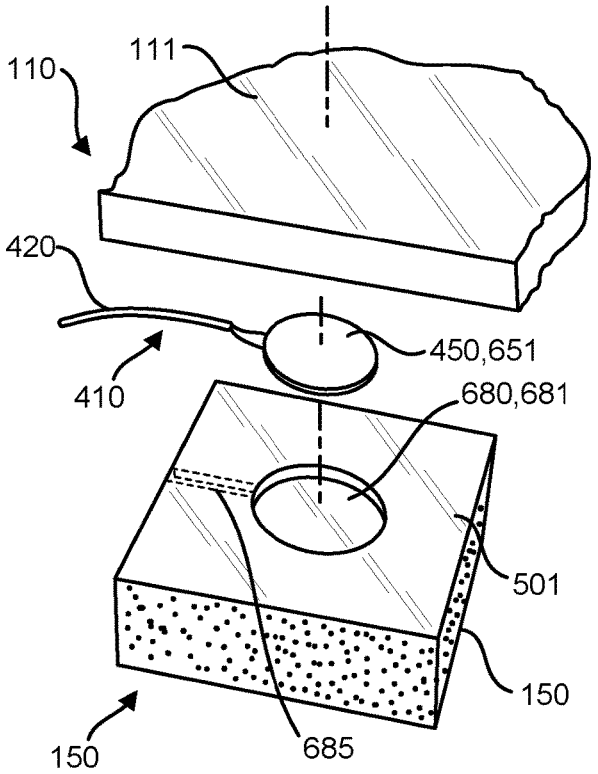
FIG. 6B is a detail top perspective view of the foot percussion device of FIG. 1 showing the assembly of the sensor and the board of FIG. 6A in accordance with another aspect of the current disclosure.

FIG. 6A is a detail bottom perspective view of the device 100 of FIG. 1 showing an assembly of the sensor 450 of the device 100 of FIG. 1 and the board 110 of the device 100 of FIG. 1. In some aspects, as shown in FIGS. 4A and 4B, the sensor 450 can be affixed to the board 110 and can be positioned inside a sensor cavity 680. In other aspects, as shown in FIG. 6A, the sensor 450 can be affixed to the board 110 without the sensor cavity 680. More specifically, when the sensor cavity 680 is present, the sensor cavity 680 can be defined in one of the board 110, as shown in FIG. 6A, and the spacer 150, as shown in FIG. 6B. More specifically, a bottom surface 681 of the sensor cavity 680 can be offset from and recessed below the lower surface 112 of the board 110 or the top surface 501 of the spacer 150. In some aspects, as shown, a mating surface 651 (shown in FIG. 6B) of the sensor 450, which can be proximal to the board 110 and opposite from a distal surface 652 of the sensor 450, can be received within the sensor cavity 680 and can be affixed to the bottom surface 681 of the sensor cavity 680. The bottom surface 681 can thereby coincide with the lower surface 112 of the board 110. In some aspects, as shown, the sensor 450 can be disc-shaped and can define a thickness. More specifically, the sensor 450 can define an overall diameter or width, and an overall diameter or width of the sensor cavity 680 can be larger than the overall diameter or width of the sensor 450. In some aspects, the overall diameter or width of the sensor 450 can be approximately one inch. In some aspects, the overall diameter or width of the sensor 450 can be between 1.0 and 1.1 inches. In some aspects, the overall diameter or width of the sensor 450 can be between one and two inches. At least the mating surface 651 can define a flat surface to facilitate full or maximum contact with the lower surface 112 of the board 110. When in contact with the board 110, each sensor 450 can convert mechanical vibrations in the board 110 to an electrical voltage transmittable through the lead wire 420 and the audio jack 170. More specifically, the sensor 450 can be so configured to pick up and convert physical deformation or movement of the board caused by the vibrations to the aforementioned electrical voltage. The lead wire 420 can comprise a pair of conductors 622 and one or more insulated coverings 624. In some aspects, the lead wire 420 can be recessed within a slot or groove 685, which can be defined in the board 110 some or all of a distance or path between the sensor 450 and the audio jack 170. In some aspects, an adhesive material can affix the sensor 450 inside the sensor cavity 680 or otherwise secure the sensor 450 to the board 110. More specifically, the mating surface 651 can comprise an adhesive material—for example and without limitation, a pressure-sensitive adhesive with a releasable liner (e.g., double-sided tape with a liner)—for affixing the sensor 450 to the board 110. In some aspects, a strip, sheet, bar, or other shape of material can cover the sensor 450 without holding or touching the sensor 450.

FIG. 6B is a detail top perspective view of the device 100 of FIG. 1 showing the assembly of the sensor 450 and the board 110 of FIG. 6A in accordance with another aspect of the current disclosure. In some aspects, as shown, the sensor 450 can be received within the sensor cavity 680—here, defined in the spacer 150—and the mating surface 651 can still be affixed to the bottom surface 112 of the board 110. In some aspects, the lead wire 420 can be recessed within the groove 685, which can be defined in the spacer 150. In some aspects, one or more of the sensors 450 can be positioned against and affixed to the upper surface 111 of the board 110. In some aspects, one or more of the sensors 450 can be positioned indirectly against the board 110 by positioning a strip or sheet of material (e.g., aluminum) between the one or more sensors 450 and the board 110. The one or more sensors 450 can be affixed to such material, and the material can be affixed to the board 110. In some aspects, however, direct contact between the one or more sensors 450 and the board 110 can facilitate sensing of the vibrations in the board 110.

Figure 7:
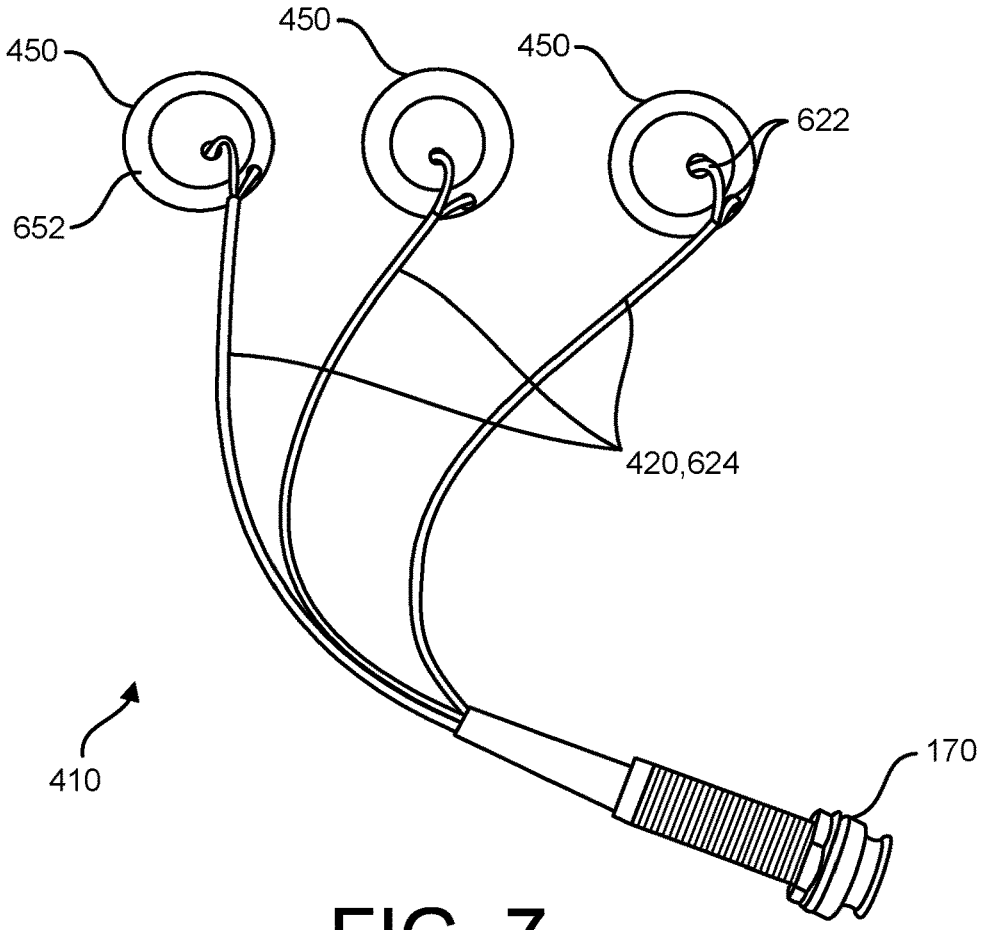
FIG. 7 is a bottom perspective view of a sensor harness of the device of FIG. 1.

FIG. 7 is a bottom perspective view of the sensor harness 410 of the device 100 of FIG. 1. In some aspects, as shown, the sensor harness 410 can comprise a plurality of the sensors 450, the construction of which can be as described above, the lead wire 420 for each sensor 450, and the audio jack 170. The sensor 450 can be the type as might typically used in an acoustic guitar. As will be described below, the sensors 450 can be in electrical communication with each other and, more specifically, can be connected in parallel arrangement with respect to each other by connecting the lead wires 120 as in FIG. 11. The conductors 622 of the lead wire 420 of each of the sensors 450 can be secured to the sensor 450 with solder by a soldering process. The audio jack 170 can define a threaded portion and a fastener.

Figure 8:
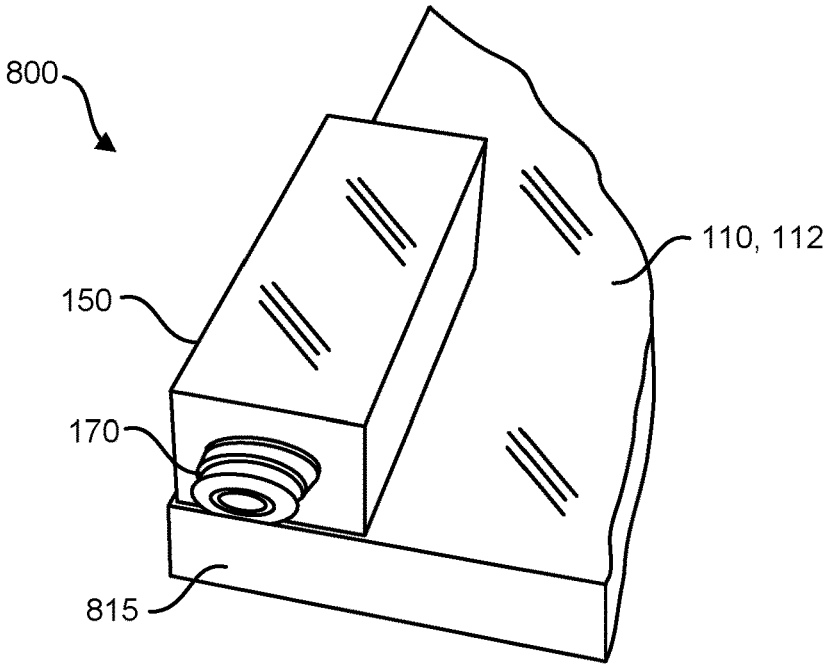
FIG. 8 is a detail bottom perspective view of the device of FIG. 1 showing an assembly of an audio jack of the device of FIG. 1 and the board of FIG. 6A.

FIG. 8 is a detail bottom perspective view of the device 100 of FIG. 1 showing an output connector assembly 800 comprising the audio jack 170 of the device 100 of FIG. 1 and secured to the board 110. The audio jack 170 can define an industry-standard quarter-inch (¼-inch) nominal opening, which can receive a standard quarter-inch (¼-inch) nominal instrument cable such as an instrument cable 1320 (shown in FIG. 13). The audio jack 170 can be positioned proximate to and can optionally protrude from an edge 815 of the board 110 such as, for example and without limitation, an edge defined by one of the ends 115,116,117,118. In some aspects, the audio jack 170 can set flush with the edge 815 or only a tip of the audio jack 170 can protrude from the edge 815. The spacer 150 or other holder can define a hole or slot to receive the audio jack 170. The hole can define a half-inch (½-inch) diameter. In some aspects, the audio jack 170 can be received within or attached directly to the board 110. The spacer 150 or other holder can be mounted to the board 110 with a fastener (not shown). The fastener can comprise an adhesive, braces or brackets (not shown), and/or a mechanical joining element such as, for example and without limitation, a nail, a screw, or a rivet.

Figure 9:
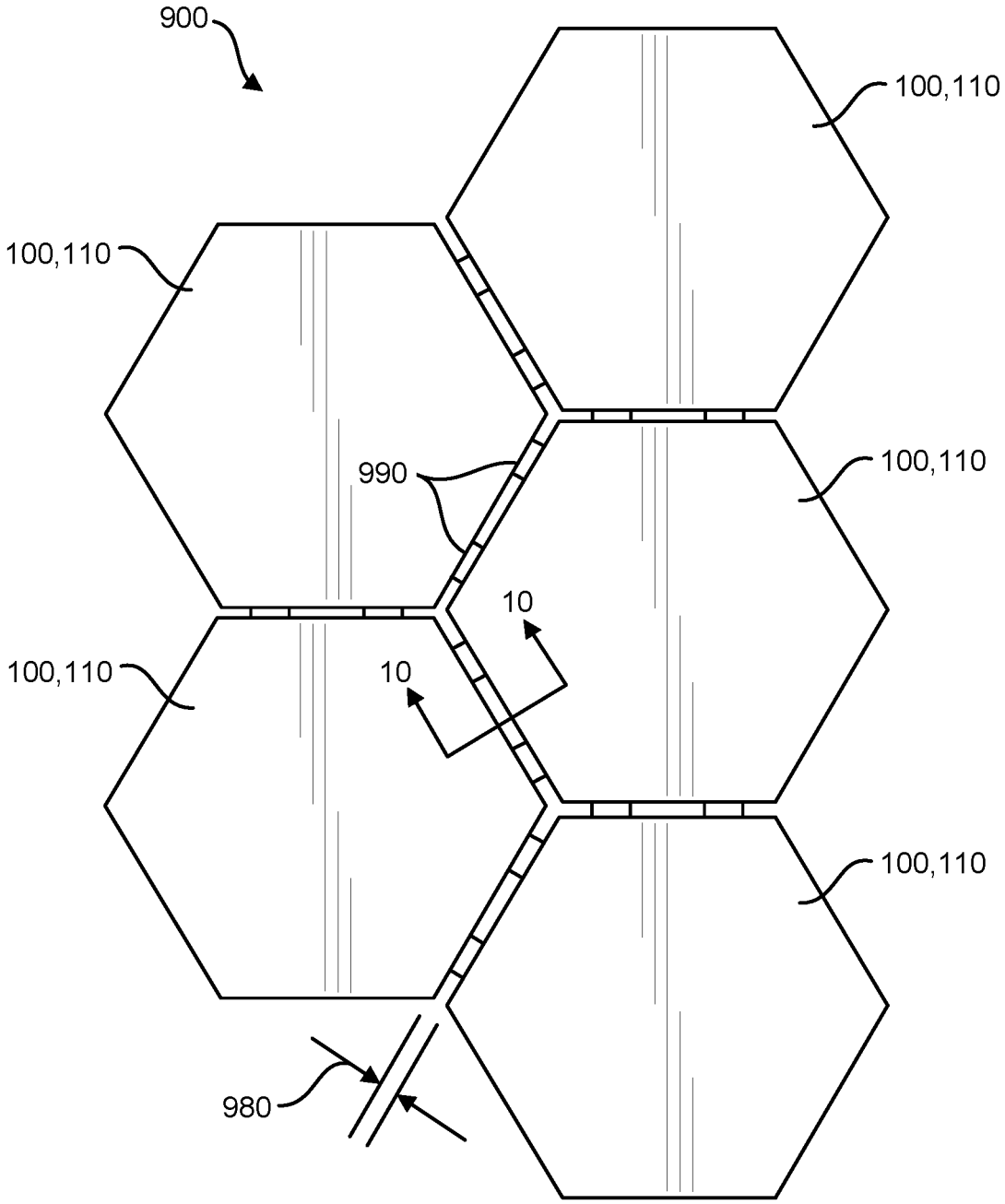
FIG. 9 is an assembly of a plurality of the devices of FIG. 1 in accordance with another aspect of the current disclosure.

FIG. 9 is an arrangement or assembly 900 of a plurality of the devices 100 of FIG. 1 in accordance with another aspect of the current disclosure. As shown, each of the devices 100 and the respective boards 110 thereof can be shaped and otherwise configured to nest within an arrangement of the plurality of the devices 100. In some aspects, as shown, each of the boards 110 and, more generally, the devices 100 can define a hexagonal shape. In some aspects, the boards 110 and, more generally, the devices 100 can define another shape and gaps between the boards 110 can vary. As shown, a fastener 990 can join adjacent devices 100 to each other. The devices 100 can be isolated from each other so as to allow each to vibrate independently. For example and without limitation, a gap 980 can isolate the devices 100. For example and without limitation, the gap 980 can be defined between adjacent devices 100 and can extend partially or completely between the devices 100. In some aspects, a gap-filler such as a rubber or foam material can optionally be positioned therein.

Figure 10:
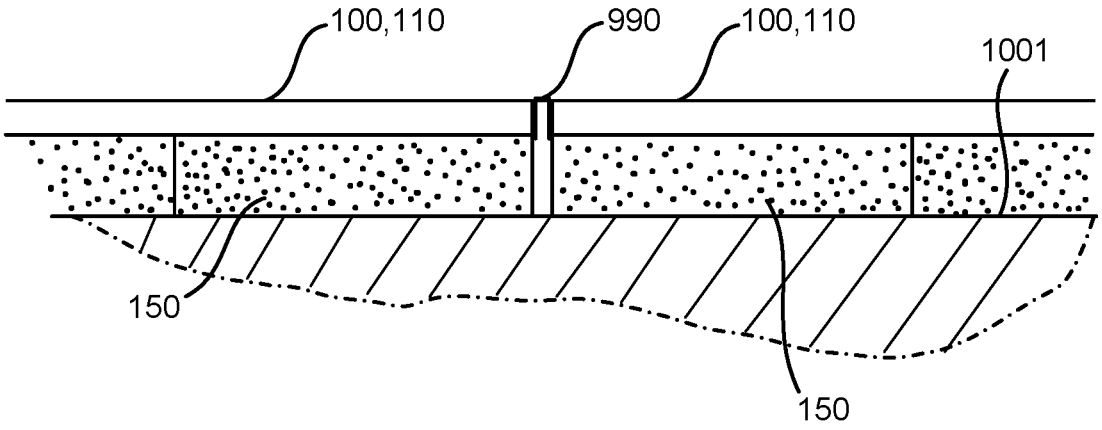
FIG. 10 is a sectional view of the assembly of FIG. 9 taken from line 10-10 of FIG. 9.

FIG. 10 is a sectional view of the assembly 900 of FIG. 9 taken from line 10-10 of FIG. 9. In some aspects, the fastener 990 can be a hook-and-loop fastener. More specifically, a first portion of the fastener 990 can comprise "hooks" and can be secured to a first device 100, and a second portion of the fastener 990 can comprise "loops" and can be secured to a second device 100. Upon contact with each other, the "hooks" of the first portion can engage with the "loops" of the second portion and thereby secure a position of the second device 100 with respect to the first device 100. In some aspects, a shown, the first portion and the second portion of the fastener 990 can be joined such as the leaves of a hinge and the devices can fold for storage against each other with a point or line of connection between the first portion and the second portion of the fastener 990 being a hinge point. In other aspects, the fastener 990 can comprise joining elements or a mechanical interlock comprising, for example and without limitation, one or more rigid or flexible—and, optionally, elastic—straps and/or one or more screws, pins, or hooks (for example and without limitation, a hook extending between the pair of devices 100 to engage an opening in each of the respective boards 110 of the pair of devices 100).

Figure 11:
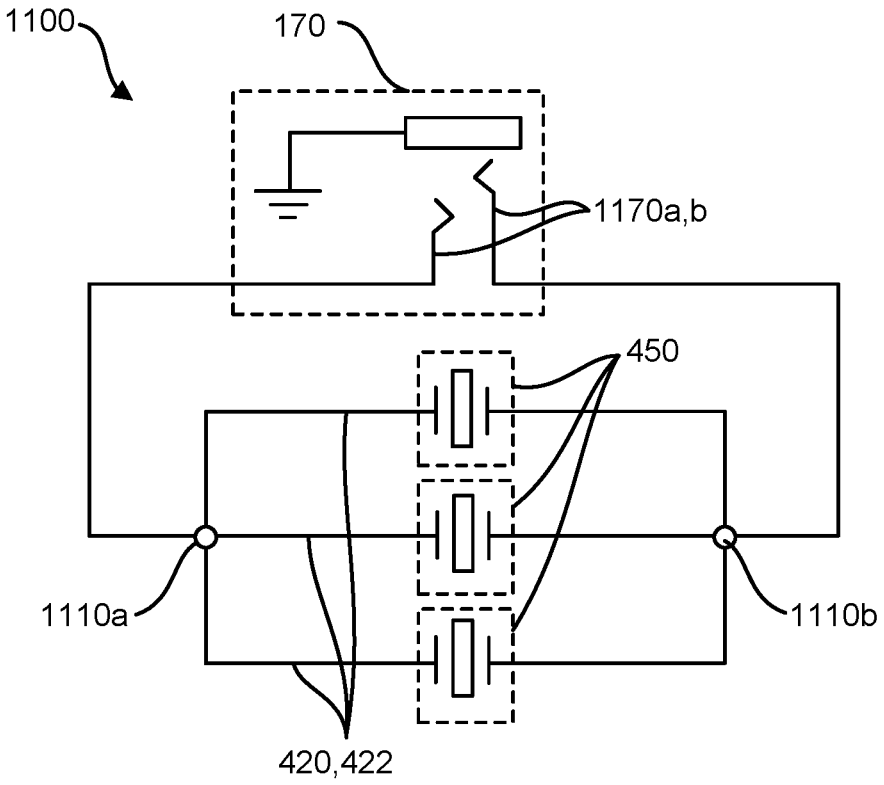
FIG. 11 is an electrical schematic of a system comprising the device of FIG. 1.

FIG. 11 is an electrical schematic or circuit 1100 of the device 100 of FIG. 1. Shown in symbolic form, each of the sensors 450 can be connected in parallel to the audio jack 170. In some aspects, as shown, the lead wires 420 of a corresponding sensors 450 can connect at nodes 1110*a,b* and through the nodes 1110*a,b* to the single audio jack 170. In such an arrangement, vibration picked up by any one or all of the sensors 450 can result in a voltage across the terminals 1170*a,b* of the audio jack 170. More specifically, as an impact or impact force on the board 110 increases, the voltage produced by the sensor 450 can increase and the sound resulting from the impact, including when amplified, can also increase. In some aspects, the nodes 1110*a,b* can be defined on the terminals 1170*a,b* of the audio jack 170 and the lead wires 420 can be secured with solder by a soldering process. In some aspects, a single sensor 450 can connect to a separate audio jack 170, in which case only vibration picked up by and thereby resulting in a voltage at the sensor 450 can result in a voltage across the terminals 1170*a,b* of the corresponding audio jack 170. In such aspects, different audio jacks 170 can be respectively tied to different sensors 450 or groups of sensors 450 on a single board 110 or on separate boards 110 to create multiple sensor circuits 1100. The audio jacks 170 can be placed in electrical communication with different inputs on sound equipment 1310 such as, for example and without limitation, a drum machine to create different amplified sounds. More specifically, the instrument cable 1420 can join one or more of the devices 100 and the drum machine, and a separate cable or cord can connect the drum machine, which can be a drum module, to one or more speakers. The drum machine can be, for example and without limitation, a YAMAHA DTX-502 electronic drum module. In some aspects, in which different audio jacks 170 can be respectively tied to different sensors 450 or groups of sensors 450 on a single board 110 to create multiple sensor circuits 1100, two or more portions of the device 100—each of which can comprise a separate sensor circuit 1100—can be isolated from each other so as to allow each to vibrate independently. For example and without limitation, the board 110 can be divided into or formed from separate portions by assembly of several portions or by forming an opening at least partially isolating the portions. For example and without limitation, a gap can extend partially or completely between the portions of the board 110. In some aspects, a gap-filler such as a rubber or foam material can optionally be positioned therein.

FIG. 12 is a side perspective view of the device 100 in accordance with another aspect of the current disclosure in which the board 110 of the device 100 and, more generally, the device 100 itself can be folded against itself or a pair of devices 100 can be folded against each other for storage and/or transport. More specifically, the device 100 can comprise a hinge to facilitate folding. The device 100 can comprise handles 1210 and can fold into a case. Each of multiple devices can be configured to nest and/or stack against each other for storage and/or transport. As described above, the spacers 150 can be removed from the board 110 for transport and/or storage of the device 100. The device 100 can thus be portable for use on any one of a variety of floor surfaces 1001 (shown in FIG. 10) without modification of the floor surface 1001.

Figure 13:
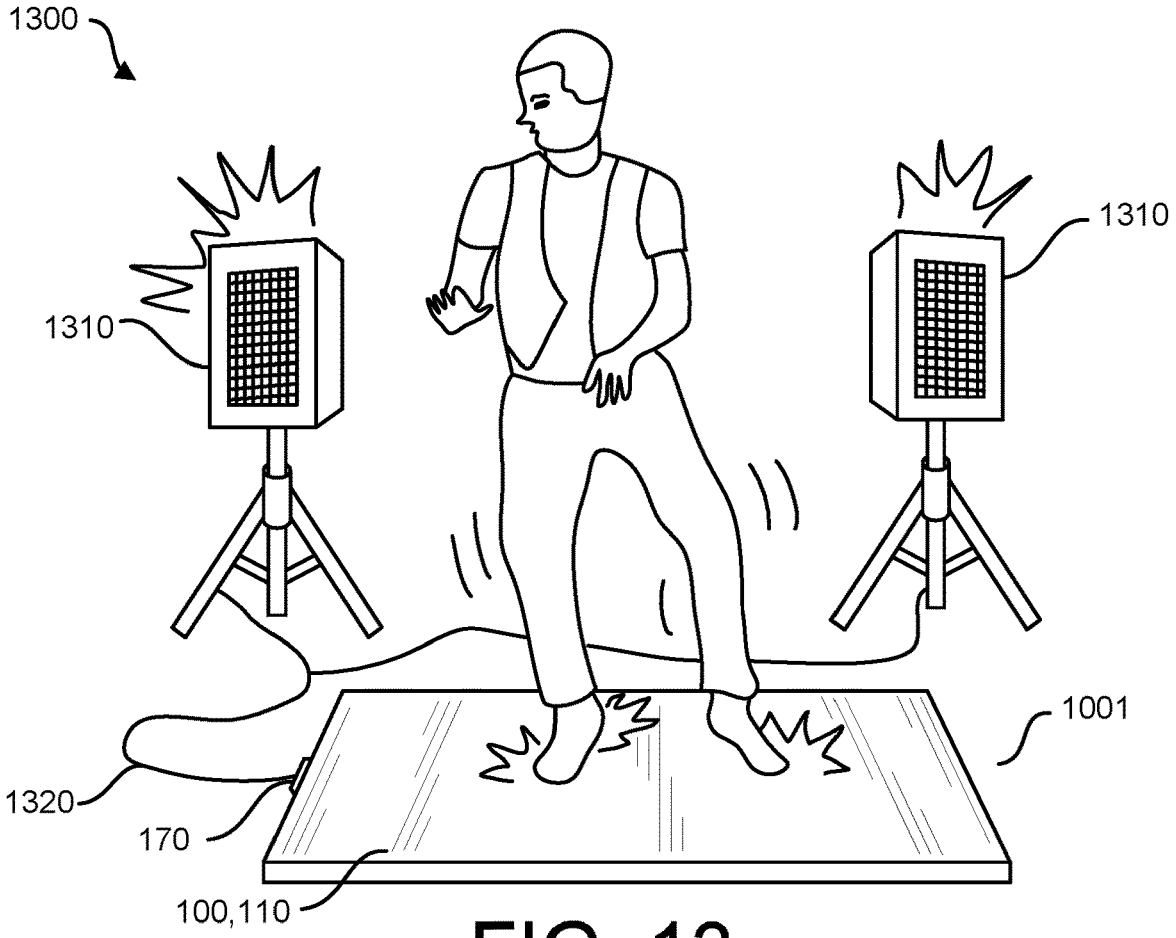
FIG. 13 is a side perspective view of a system comprising the device of FIG. 1.

FIG. 13 is a side perspective view of a system 1300 comprising the device of FIG. 1. The system 1300 can comprise the device 100, one or more pieces of sound equipment 1310, and the instrument cable 1320 in communication with each of the device 100—through the audio jack 170—and the sound equipment 1310. In some aspects, the instrument cable 1320 can connect with a single piece of the sound equipment 1310 such as, for example and without limitation, an amplifier. In some aspects, the instrument cable 1320 can connect with the sound equipment 1310 through a second piece of sound equipment (not shown) such as, for example and without limitation, a drum machine, a loop machine, a laptop computer, or another electronic device such as, for example and without limitation, a tablet or phone running an application such as, for example and without limitation, an iMic application available at the Apple Store for iOS devices. The electronic device can connect to wirelessly to the sound equipment 1310 via wireless technology such as, for example and without limitation, BLUETOOTH technology associated with BLUETOOTH SIG, INC. of Kirkland, Wash., U.S.A. Again, the sound equipment 1310 can be in electrical communication with the device 100 through the instrument cable 1320, and the sound equipment 1310 can be configured to amplify the electrical signals originating from the one or more sensors 450.

A user of the device 100 can use the board while wearing shoes or without shoes. To adjust for softer-soled shoes or the use of bare feet, the volume can be turned up to adjust for some of the impact against the board 110 being absorbed by the shoes or the feet of the user.

Figure 14:
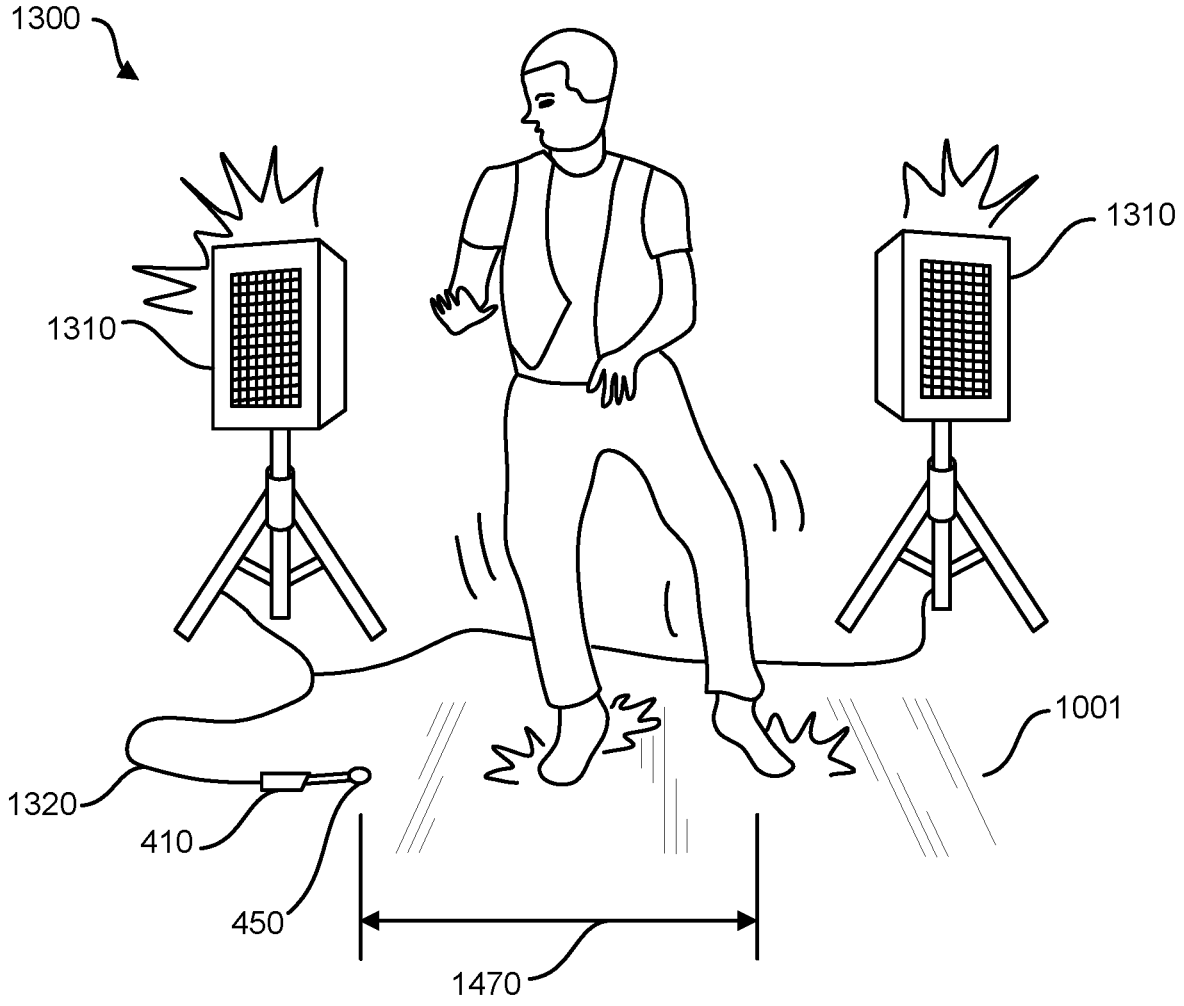
FIG. 14 is a side perspective view of a system comprising the device of FIG. 1 in accordance with another aspect of the current disclosure without the board of FIG. 6A.

FIG. 14 is a side perspective view of the system 1300 comprising the device of FIG. 1 in accordance with another aspect of the current disclosure without the board 110 of FIG. 6A. The system 1300 requires no board 110 because the sensor 450 can be secured directly to the floor surface 1001. Without the board 110, the device 100 can comprise only the sensor 450 and the sensor harness 410. More specifically, the sensor 450 can be positioned on the floor surface 1001, and mechanical vibrations resulting from or caused by impacts against the floor surface 1001 by a foot of a user of the system 1300 can be converted into an electrical signal, transmitted through the sensor harness 410 and the instrument cable 1320, and amplified through the sound equipment 1310. In some aspects, a plurality of sensors 450 can be positioned on the floor surface 1001 and through a single circuit 1100 (shown in FIG. 11) or a plurality of circuits 1100 and can produce one or more channels of output and, thereby sound, through the sound equipment 1310.

In some aspects, a method of manufacturing the foot percussion device 100 can comprise one or more of the following steps (which can be accompanied by any other steps disclosed above or below):

1. Sanding down one or more surfaces of the board 110 to reduce the risk of splinters from the wood, as desired.
2. Applying a logo or other graphics to a surface of the board 110. For example and without limitation, the method can comprise using an ink transfer method with MOD PODGE resin or other glue, sealer, and/or finish material and an inverted image. More specifically, the method can comprise applying the resin to the image and to a target area on the board 110. The method can comprise letting the image dry on the board 110 for at least 24 hours. The method can comprise using a warm sponge or cloth to rub the paper off gently and letting the surface dry to confirm whether any of the paper remains. The method can comprise repeating the wetting and drying steps until all the paper film is removed then applying some oil to the image to prevent the film from coming back.

3. Connecting one or more of the sensors 450 to the sensor harness 410.
4. Inserting the audio jack 170 of the sensor harness 410 into the spacer 150 or other holder. The method can comprise positioning the holder at the edge of the center of the board 110. The spacer 150 or the holder receiving the audio jack 170 can have a half-inch hole drilled or otherwise formed in the center. The method can comprise sliding the audio jack 170 into the hole. The method can comprise applying a cover to the audio jack 170. The method can comprise using wood glue to attach a sensor cover to the board 110.
5. Positioning the one or more sensors 450 on the board 110. The method can comprise forming the sensor cavity 680 in a surface of one of the board 110 and the spacer 150. The method can comprise forming a groove 685 in a surface of one of the board 110 and the spacer 150. The method can comprise embedding the sensors in the wood and covering the sensor 450 with a potting material. The method can comprise, in some aspects, aligning the sensors 450 down the center of the board. The method can comprise removing the adhesive from each sensor 450. The method can comprise attaching each sensor 450 to the center of the board 110. The method can comprise lining up multiple sensors 450 in a straight line down the center for the board. The method can comprise positioning the sensors 450 equidistant from each other. The method can comprise using rubber tap glue on top of the lead wires 420 and the sensors 450 to hold the lead wires 420 and the sensors 450 in place. The method can comprise placing the sensors 450 on aluminum material and affixing the aluminum material to the board. The method can comprise mounting the sensors directly to the board 110. The method can comprise covering each sensor 450 with a piece of material. The method can comprise not touching the sensors 450 with the piece of material. The method can comprise running the one or more lead wires 420 through the board 110 and attaching them to the audio jack 170.
6. Applying the spacer 150 at each corner and in the center edge of the board 110. For additional support, the method can comprise putting a spacer 150 in the center of the board 110 on the left and right side of the sensors 450.
7. Applying a wire cover over the sensors 450 and lead wires 420.
8. Applying a coat of wood finish to the top of the board 110.
9. Applying a thin coat of resin on side edges of the board 110 to prevent splinters on the sides of the boards.

In some aspects, a method of manufacturing the foot percussion device 100 can comprise one or more of the following steps (which can be accompanied by any other steps disclosed above or below):

1. Connecting one or more of the sensors 450 to the sensor harness 410.
2. Positioning one or more of the sensors 450 in the sensor location 310*a,b,c* directly on the floor surface 1001 of the system 1300.

In some aspects, a method of using the foot percussion device 100 can comprise one or more of the following steps (which can be accompanied by any other steps disclosed above or below):

1. Positioning the board 110 on the floor surface 1001. The method can comprise positioning the board 110 on the floor surface 1001 without fasteners or adhesive.
2. Performing a dance or making other movements on the upper surface 111 of the board 110.
3. Sensing with the sensor 450 mechanical vibrations resulting from impacts against an upper surface of the board 110 by, for example and without limitation, a foot of a user of the system 1300.
4. Compressing the spacer during impacts against the upper surface of the board by the foot of the user of the system. The method can comprise cushioning the impact on the user from the impacts against the board 110. The method can comprise compressing the spacer 150 without the spacer 150 making any audible noise.
5. Isolating the board 110 from direct contact with the floor surface 1001 with the one or more spacers 150.
6. Converting the mechanical vibrations to electrical signals with the sensor 450.
7. Transmitting the electrical signals from the sensor 450 to sound equipment 1310 of the system 1300 via the instrument cable 1320.
8. Amplifying the electrical signals with the sound equipment 1310 to produce a sound audible through speakers of the system 1300.

In some aspects, a method of using the foot percussion device 100 can comprise one or more of the following steps (which can be accompanied by any other steps disclosed above or below):

1. Positioning the sensor 450 in the sensor location 310*a,b,c* directly on the floor surface 1001 of the system 1300. The method can comprise securing the sensor 450 to the floor surface 1001 with a temporary adhesive (i.e., with a removable adhesive material that is removable, at least for a certain duration of time, without damaging or destroying the sensor 450 or the floor surface 1001, including a finish of the floor surface 1001).
2. Setting the sensing distance 1470 defined between a center of each of the impacts and the sensor locations 310 to less than or equal to seven feet. Setting the sensing distance 1470 to less than or equal to five feet.
3. Performing a dance or making other movements on the board 110 by impacting the board 110 with a foot of a user or an extension thereof (e.g., a shoe). In some aspects, the user can impact the board 110 and the device can create or at least amplify sound with another part of the body such as, for example and without limitation, the hands, as they may desire.
4. Sensing with the sensor 450 mechanical vibrations resulting from impacts against the floor surface 1001 by a foot of a user of the system 1300.
5. Converting the mechanical vibrations to electrical signals with the sensor 450.
6. Transmitting the electrical signals from the sensor 450 to sound equipment 1310 of the system 1300 via the audio jack 170 and the instrument cable 1320.
7. Amplifying the electrical signals with the sound equipment 1310 to produce a sound audible through speakers of the system 1300.
8. Identifying movement on the floor surface 1001 by for security purposes.

In some aspects, use of the foot percussion device 100 can result in one or more of the following benefits (which can be accompanied by any other benefits disclosed above or below):

1. Dancers conserving their energy and thereby allowing them to perform for longer periods of time. Because the sound is amplified or otherwise enhanced the dancer does not have to work as hard to be heard over other live instruments.

2. Dancers being able to plug the device 100 into the venue sound system and blend in or compete with other instruments.
3. Bands not needing to lower their music to allow for dancer to be heard.
4. Dancers having a stage in their own facility for use during participation in an online class.
5. Better compatibility with sound studio recording equipment, loop machines and drum modules
6. The device 100 customizable with company designs or images for functional art.
7. Dancers no longer needing to wear heavy performance microphones on their bodies.
8. Compatible with sound equipment such as drum module. A tap dance performer, for example, can not only tap but can have their taps sound like the band with drum sounds such as, for example and without limitation, cymbals, congas, and various types of drums.
9. Dancers are also be able to "battle" themselves by plugging the device 100 into a loop machine which would allow dancers to pre-record a portion of their routine and layer their sound on top of them dancing live.
10. As a result of the sensors being built into the board 110 the entire surface of the device 100 can be used.
11. The device 100 can facilitate the recording of Follies for video games and movies. A user can plug the foot percussion device into a digital sound boards to record foot steps or perform dance "voice overs" for movies.
12. The device 100 disclosed herein can protect the dancer from constant impact against any of the hard surfaces on which they would otherwise dance.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A foot percussion device comprising:

a rigid board defining an upper surface and a lower surface distal from the upper surface;

a spacer secured to the lower surface of the board, the spacer extending from the lower surface of the board and to a floor surface on which the device is placed, the spacer being compressible and defining a height before compression, a material forming the spacer defining a density of less than or equal to 4.0 pounds per cubic foot, the spacer configured to isolate the board from contact with the floor surface and cushion an impact on a user of the foot percussion device from impacts against the board the user's feet;

an audio jack; and a sensor in contact with and secured to one of the upper surface and the lower surface of the board, the sensor configured to convert mechanical vibrations in the board to electrical signals transmittable through the audio jack.

2. The device of claim 1, wherein the board comprises a plywood material and defines a nominal thickness of at least 0.5 inches.

3. The device of claim 1, wherein a compressive strength of a material forming the spacer can be less than or equal to 46 PSI at 25% of the height.

4. The device of claim 1, wherein a material forming the spacer comprises one of polyethylene, polypropylene, and polyurethane.

5. The device of claim 1, further comprising a plurality of sensors, each of the plurality of sensors being a piezo transducer, each of the sensors being in contact with and secured to the one of the upper surface and the lower surface of the board.

6. The device of claim 5, wherein adjacent sensors of the plurality of sensors are spaced apart from each other by a sensor separation distance of six to twelve inches.

7. The device of claim 1, further comprising a plurality of spacers secured to and extending from the lower surface of the board, adjacent spacers of the plurality of spacers spaced apart from each other by a spacer separation distance and defining a gap therebetween, each of the plurality of spacers being compressible and defining a height of at least one half inch, each of the plurality of spacers configured to isolate the board from direct contact with the floor surface on which the device is placed.

8. The device of claim 1, wherein the sensor is a piezo transducer.

9. The device of claim 8, wherein the sensor is secured to the lower surface of the board.

10. The device of claim 9, wherein the sensor is positioned inside a sensor cavity, a bottom surface of the sensor cavity being offset from the lower surface of the board and defined in one of the board and the spacer.

11. The device of claim 1, wherein a fastener securing the spacer to the board is a removable and reusable fastener.

12. A system comprising the device of claim 1, the system further comprising sound equipment in electrical communication with the board through a cable, the sound equipment configured to amplify the electrical signals from the sensor, the sound equipment being one of an amplifier, a loop machine, and a drum machine.

13. A method of using a foot percussion device, the method comprising:

positioning a board of the device on a floor surface, the device comprising a sensor in contact with and secured to the lower surface of the board, the sensor being a piezo transducer;

sensing with the sensor mechanical vibrations resulting from impacts against an upper surface of the board by a foot of a user of a system comprising the device, the device comprising a spacer secured to and extending from the lower surface of the board, the spacer being compressible and defining a height before compression, a material forming the spacer being one of a material defining a compressive strength of less than or equal to 46 PSI at 25% of the height and a material defining a density of less than or equal to 4.0 pounds per cubic foot, the spacer configured to isolate the board from contact with the floor surface;

cushioning an impact on the user of the foot percussion device from impacts against the board by the user's feet;

converting the mechanical vibrations to electrical signals with the sensor;

transmitting the electrical signals from the sensor to sound equipment of the system via a cable; and amplifying the electrical signals with the sound equipment to produce a sound audible through speakers of the system.

14. The method of claim 13, wherein positioning the board on the floor surface comprises positioning the board on the floor surface without fasteners or adhesive.

15. The method of claim 13, wherein the method comprises the user performing a dance on the upper surface of the board.

16. A method comprising:

positioning a sensor of a system in a sensor location directly on an upper surface of a floor surface of a permanent structure, the sensor being a piezo transducer;

sensing with the sensor mechanical vibrations resulting from impacts against the floor surface by a foot of a user of the system;

converting the mechanical vibrations to electrical signals with the sensor;

transmitting the electrical signals from the sensor to sound equipment of the system via a cable; and amplifying the electrical signals with the sound equipment to produce a sound audible through speakers of the system.

17. The method of claim 16, wherein the method comprises the user performing a dance on the upper surface of the floor surface.

18. The method of claim 17, wherein a sensing distance between a center of each of the impacts and the sensor location is less than or equal to five feet.

19. The method of claim 13, further comprising:

positioning each of a plurality of the foot percussion devices adjacent to each other on the floor surface; and contacting each of the plurality of the foot percussion devices with the foot or feet of the user in a single performance.

20. A foot percussion device comprising:

a rigid board defining an upper surface and a lower surface distal from the upper surface;

a spacer secured to the lower surface of the board, the spacer extending from the lower surface of the board and to a floor surface on which the device is placed, the spacer being compressible and defining a height before compression of at least one-half inch, the spacer further defining a length of at least two inches and a width of at least two inches, the spacer configured to isolate the board from contact with the floor surface and substantially cushion an impact on a user of the foot percussion device from impacts against the board the user's feet;

an audio jack; and a sensor in contact with and secured to one of the upper surface and the lower surface of the board, the sensor configured to convert mechanical vibrations in the board to electrical signals transmittable through the audio jack.

* * * * *